United States Patent [19]

Hoffmann

[11] 4,349,340

[45] Sep. 14, 1982

[54] MAN-PROPELLED HYDROFOIL BOAT

[76] Inventor: Benjamin Hoffmann, 4733 - 36th Ave. South, Minneapolis, Minn. 55406

[21] Appl. No.: 127,835

[22] Filed: Mar. 6, 1980

[51] Int. Cl.[3] ..... B63H 16/14

[52] U.S. Cl. ..... 440/30; 114/282; 114/162

[58] Field of Search ..... 440/29, 37, 21, 25, 440/26, 27; 114/274, 280, R, 162

[56] References Cited

U.S. PATENT DOCUMENTS

| | | | |
|---|---|---|---|
| 1,410,876 | 3/1922 | Bell | 114/274 |
| 1,732,679 | 10/1929 | Haby | 440/37 X |
| 2,705,468 | 5/1955 | Dix | 114/274 X |
| 2,749,870 | 6/1956 | Vavra | 114/282 |
| 2,931,332 | 5/1960 | Hebrank | 114/274 X |
| 2,991,749 | 7/1961 | Patterson | 114/162 X |
| 3,094,960 | 6/1963 | Lang | 114/282 X |
| 3,221,699 | 12/1965 | Vidach | 114/162 |
| 3,306,246 | 2/1967 | Reder | 114/280 |
| 3,574,300 | 4/1971 | Moore | 114/274 X |
| 3,613,622 | 10/1971 | Bueller | 114/282 |
| 3,785,319 | 1/1974 | Danforth | 114/280 |
| 4,003,328 | 1/1977 | Feldman | 114/144 R |

*Primary Examiner*—Trygve M. Blix
*Assistant Examiner*—Stephen P. Avila
*Attorney, Agent, or Firm*—Merchant, Gould, Smith, Edell, Welter & Schmidt

[57] ABSTRACT

A sporting vehicle powered only by the energy of the occupant for travelling on bodies of water at unprecedentedly high speeds. The vehicle comprises a frame supported while stationary on hulls or floats, and including a seat for the occupant and a set of pedals for enabling him to cause vehicle movement either by an air screw or a water screw. The frame is suitably reinforced and includes a rudder which can be withdrawn from the water, to reduce its drag, when conditions are appropriate. Forward and rearward hydrofoils, of V-shaped configuration, are also provided for use at low speeds, a linkage being included for lifting the low speed hydrofoil above the water surface when appropriate vehicle speed has been achieved. Normally all hydrofoils depend from the frame below the floats, and levers are provided by which the occupant can vary the angles of attack of the hydrofoils to take best advantage of environmental conditions and vehicle speed.

5 Claims, 10 Drawing Figures

FIG. 8
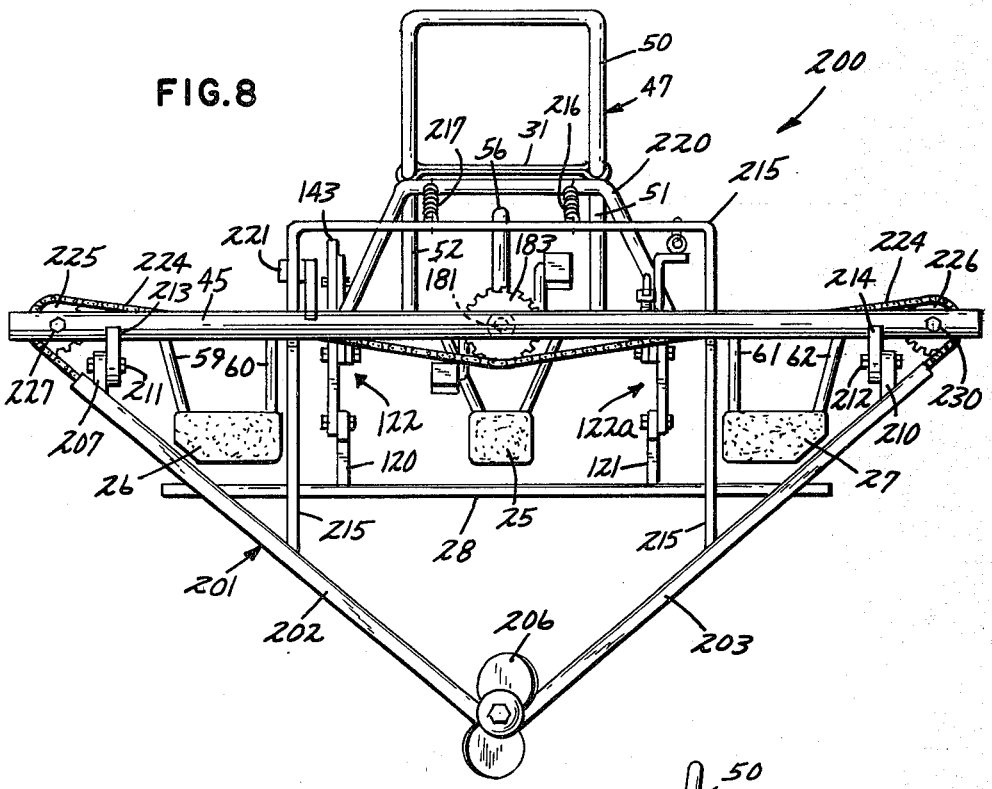
FIG. 9
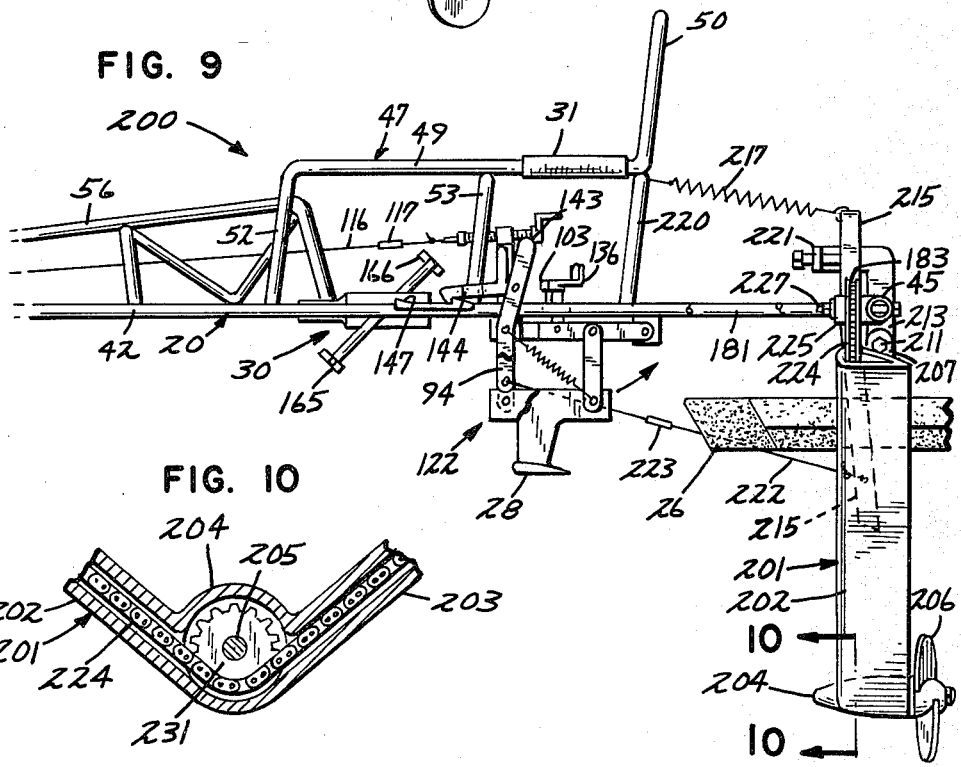
FIG. 10

MAN-PROPELLED HYDROFOIL BOAT

TECHNICAL FIELD

This invention relates to the field of vehicles, and particularly to sport vehicles designed for operation in water in hydrofoil mode by the power of a single human occupant to achieve a relatively high rate of movement.

BACKGROUND OF THE PRIOR ART

A few general comments regarding the nature and intended use of vehicles such as are here described may be conducive to a better understanding of the invention. In the first place, the power available continuously from even a very athletic man is quite limited, about three-tenths horsepower being an acceptable figure. A man in good condition can row a boat for a considerable distance, but his sustained rate of movement is very low, perhaps three miles per hour for a flat-bottomed boat or five miles per hour for a canoe. Pedal-boats and boats propelled manually are both known.

The power required to propel a conventional boat is expended almost entirely in overcoming the fluid friction or drag between the hull of the vessel and the water, the latter of course supporting the weight of the vessel and its occupant by the principle of buoyancy. It is thus clear that the rate of motion of a hulled water vehicle, for any available driving power, is limited by drag. The use of both air screws and water screws to drive water-borne vehicles is well known.

In the field of power boats the use of hydrofoils has been developed to increase the speed obtainable from an engine of given power. Such vessels when at rest are supported by a buoyant hull of minimum size; when in operation at rated speed the action of the water on suitable hydrofoils raises the vehicle so that the hull no longer engages the water, thus reducing the drag exerted against the vehicle by the liquid medium to a minimum due to the hydrofoils, and hence increasing the speed at which the vehicle can be driven by an engine of known power.

A present-day sport of increasing popularity is the construction and operation of man-powered aircraft, that is, heavier-than-air vehicles propelled and supported solely by the exertions of the occupant. The occupant must cause the vehicle to fly at such a speed that the lift of its airfoils maintains it at altitude. Flights of very respectable distance have been accomplished in properly designed vehicles of this sort, including flight across the English Channel.

BRIEF SUMMARY OF THE INVENTION

High-speed man-powered water travel can be approached in the same sporting attitude. By providing a very light hulled vehicle with hydrofoils of appropriate configuration and location it is possible to derive from forward movement of the vehicle, even at quite low speed, enough lift to raise the hull out of the water, so that the only drag thereafter is that of the hydrofoils, considerably less in magnitude, and the potential speed of the vehicle is increased proportionately.

The present invention comprises a sporting vehicle powered only by the energy of the occupant, for travelling on bodies of water, at unprecedently high speeds. It is to be realized that in a vehicle of this type all else is sacrificed to power efficiency and light weight. All controls are manual rather than automatic, the structure is tubular wherever possible, and drag reduction has been maximized. Although a streamlined configuration is required for the hydrofoils, these members can also be hollow.

A vehicle according to the invention comprises a frame supported while stationary on hulls or floats, and including a seat for the occupant and drive means including a set of pedals for enabling him to cause vehicle movement either by an air screw or a water screw. The frame is suitably reinforced and includes a rudder which can be withdrawn from the water, to reduce its drag, when conditions are appropriate. Forward and rearward hydrofoils, of V-shaped configuration, are provided for use at high speeds, at which they are never wholly submerged. A straight hydrofoil is also provided for use at low speeds, means being included for lifting the low-speed hydrofoil above the water surface when appropriate vehicle speed has been achieved. Normally all hydrofoils depend from the frame below the floats, and means are provided by which the occupant can vary the angles of attack of the hydrofoils to take best advantage of environmental conditions and vehicle speed.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

BRIEF DESCRIPTION OF THE DRAWING

In the drawing.

FIG. 8 is a view similar to FIG. 3 but showing a further embodiment of the invention using a water screw, portions being omitted for clarity of illustration;

FIG. 9 is a fragmentary view similar to FIG. 2 but showing a further embodiment of the invention; and FIG. 10 is a fragmentary section as seen from the line 10—10 of FIG. 9.

DETAILED DESCRIPTION OF THE INVENTION

Figure 1:
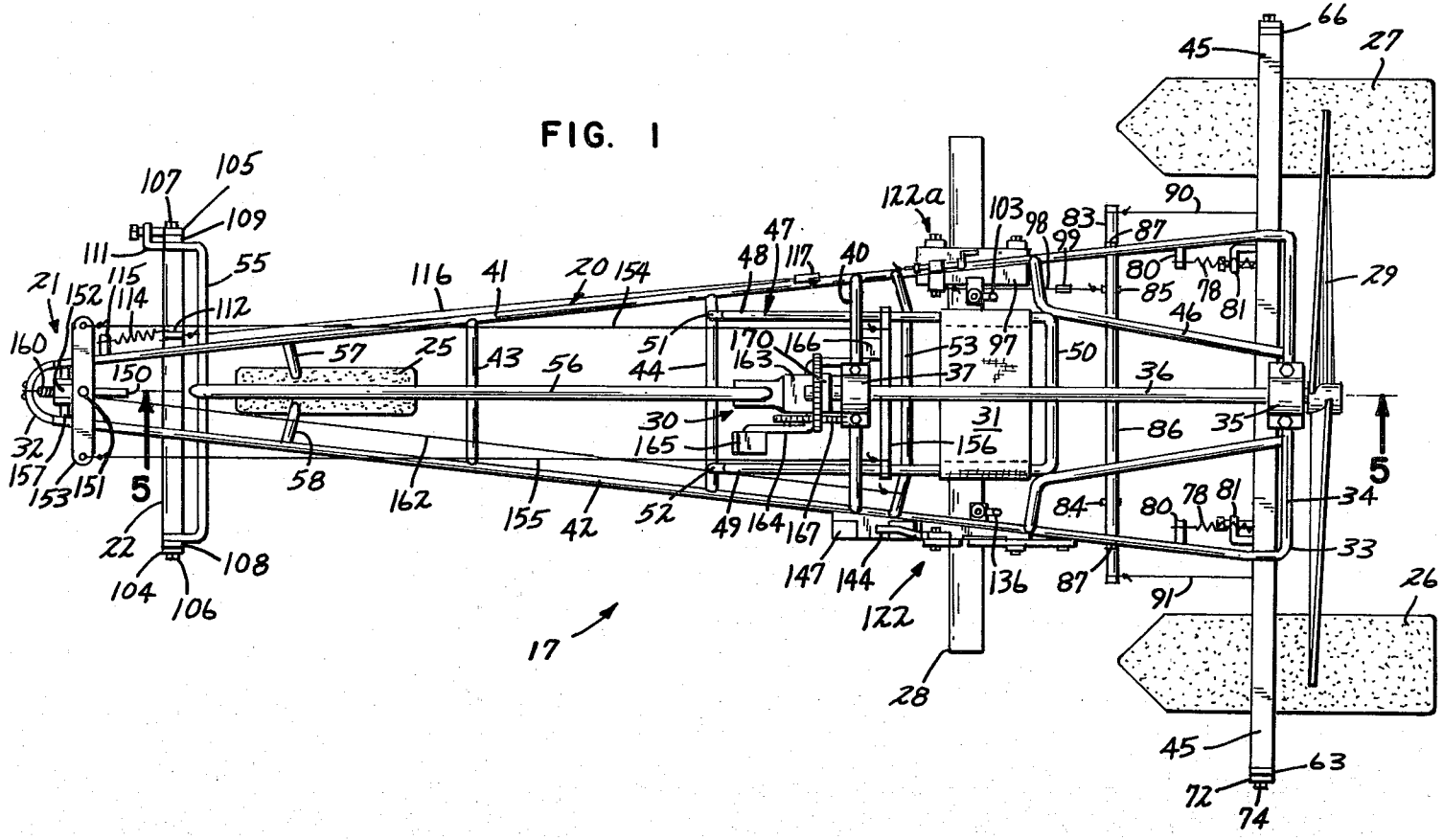
FIG. 1 is a plan view of a vehicle embodying the invention and using an air screw.

By way of preliminary explanation, when driving energy is supplied to cause motion of a body relative to a fluid, the energy is expended in overcoming a drag force D acting on the body in a direction opposite to that of the motion. The body may be such that the forward movement also results in a lift force L, that is, one which is in a direction to oppose the force of gravity on the body. If the lift force is equal to the weight of the body, the latter moves at a constant depth in the fluid, no matter how heavy it may be: if the lift force is greater or less than the weight of the body, the body rises or sinks in the fluid.

A "hydrofoil" is an elongated body of such configuration in transverse section that it can be oriented so that its transverse movement with respect to a fluid is accompanied by a lift force. The orientation is defined by an angle, between the direction of movement and a specified axis or chord of the transverse section, which is called the angle of attach. Many such configurations are known, but for a given length of any hydrofoil the driving force required to cause motion at a given speed, and the lift force resulting from that motion, vary as the angle of attack of the hydrofoil increases. The two forces do not vary in the same proportion with angle of attack: the ratio L/D of the lift force to the drag force also varies with angle of attack, but passes through a maximum value rather than increasing continuously.

The larger the ratio L/D becomes, the greater becomes the efficiency of the hydrofoil in deriving lift force from the movement of the body, or conversely, the less becomes the drag force which must be overcome to obtain a desired lift force. This means that for any available driving energy the greatest speed for a hydrofoil moving at a constant depth results when the L/D ratio is maximum, and this in turn defines the most desirable angle of attack for the hydrofoil.

It is further to be noted that for any angle of attack the lift and drag forces and their ratio vary, in different proportions, with the rate of motion, so that the most desirable angle of attack itself varies as rate of motion increases.

By way of numerical examples, a hydrofoil having a maximum L/D ratio for a speed of 9 miles per hour, at a particular angle of attack, has a reduced L/D ratio at a speed of 15 miles per hour, although the drag D and lift L forces themselves have both increased with speed.

Applying these principles to the problem of a man-powered vehicle, the following conclusions may be drawn. In order for the limited available power to produce a maximum vehicle speed, a hydrofoil arrangement must be selected which can produce enough lift at low speeds to raise and maintain the hull of the vehicle above the water surface, and yet which offers as little drag as possible to motion at higher speeds, consistent with maintaining lift. These conclusions dictate that for maximum energy efficiency a structure with variable angle of attack is desirable, and also imply possible advantages if hydrofoils of different transverse sections are usable at different vehicle speeds.

Turning now to FIGS. 1–6, a first vehicle 17 embodying the invention is shown to comprise a skeleton structure or frame 20 of light metal tubing which mounts steering apparatus 21, adjustable high-speed hydrofoil means including a forward hydrofoil 22 and dual rearward hydrofoils 23 and 24, hull means including a forward hull 25 and a pair of laterally spaced rearward hulls 26 and 27, adjustable low-speed hydrofoil means 28, and drive means including an air screw 29 powered by a pedal mechanism 30 to be actuated by the occupant of a seat 31.

The components catalogued above will now be described in detail.

Frame 20 is narrow at its forward end 32 and broad at its rearward end 33, which is bent upwardly to form a support bracket 34 for the rear bearing 35 of a shaft 36 for air screw 29. The forward bearing 37 of shaft 36 is carried on an inverted U-shaped bracket 40 secured to the sides 41 and 42 of frame 20. The frame is reinforced by cross members 43 and 44 and a rear hydrofoil support member 45.

Bracket 34 is strengthened by a second inverted U-shaped bracket 46 secured at its top to bearing 35 and at its bottom to frame sides 41 and 42. A seat frame 47 having sides 48 and 49 and a back 50 is supported forwardly on legs 51 and 52 carried by cross member 44, and is further supported by an inverted U-shaped bracket 53 carried by frame 20. Seat 31 conveniently comprises fabric which passes around the sides of frame 47 to suspend the occupant between them.

A central reinforcing member 54 is supported by cross members 44 and 43 and a forward hydrofoil support member 55. Rigidity in the vertical plane is supplied by a trusswork 56 secured to member 55 and along central member 54. Forward hull 25 is supported from sides 41 and 42 by struts 57 and 58, and rearward hulls 26 and 27 are supported from cross member 45 by struts 59, 60, and 61, 62. The combined buoyancy of hulls 25, 26 and 27 is sufficient to support the weight of the vehicle and its operator when the vehicle is stationary.

Figures 2, 4:
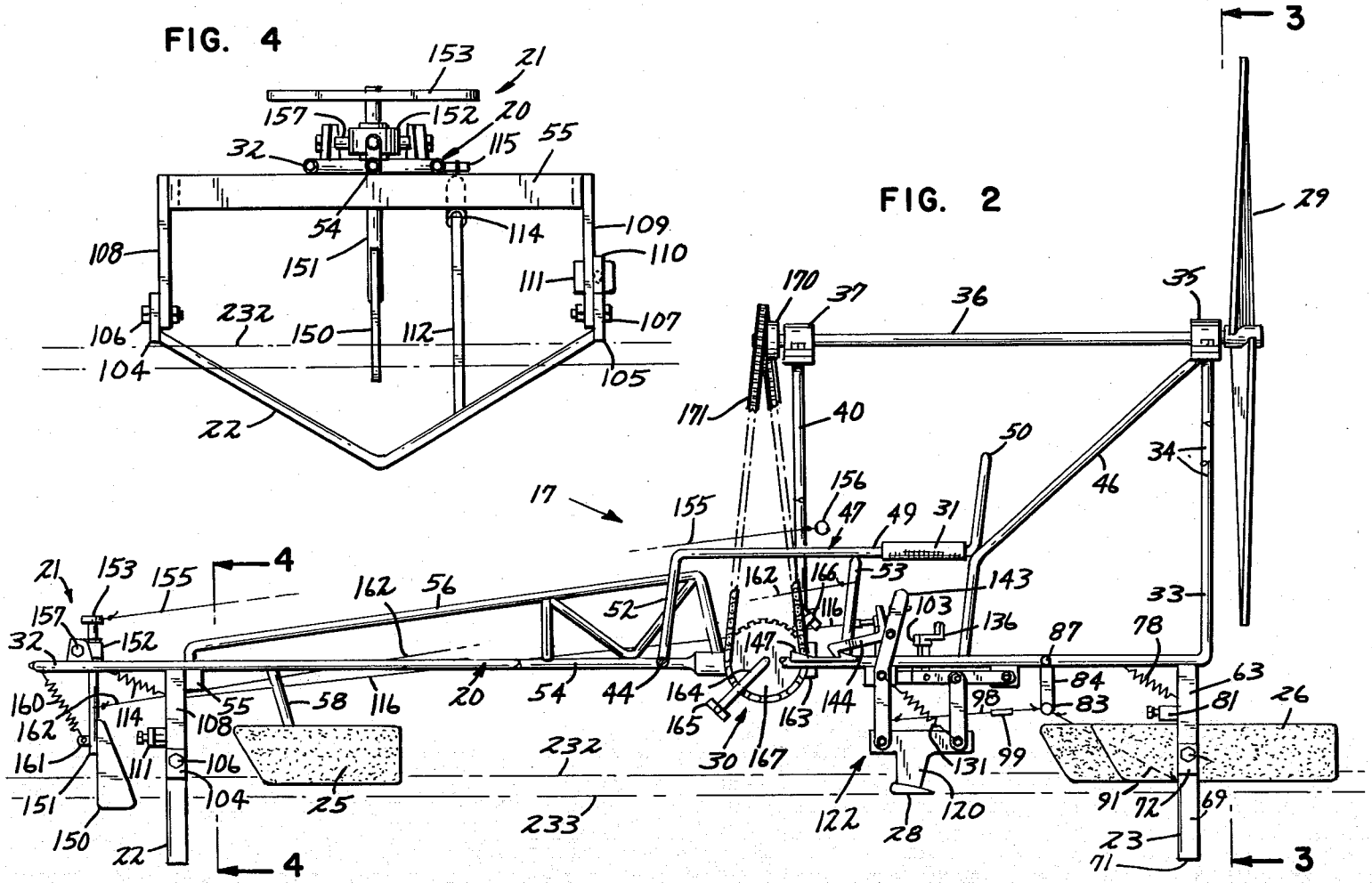
FIG. 2 is a view in side elevation of the same vehicle, parts being broken away for clarity of illustration.
FIG. 4 is a sectional view of the front end portion of the vehicle as seen from the line 4—4 of FIG. 2.
Figure 3:
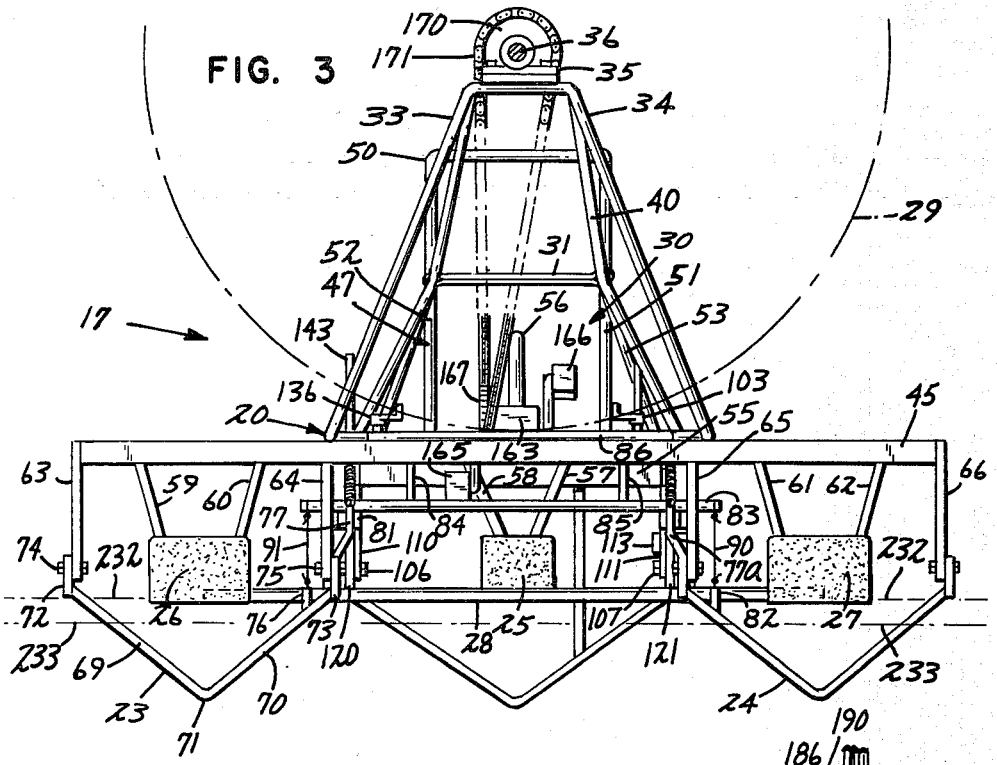
FIG. 3 is a sectional view as seen from the line 3—3 of FIG. 2, to a different scale, showing portions of the device in rear elevation.
Figures 5, 6:
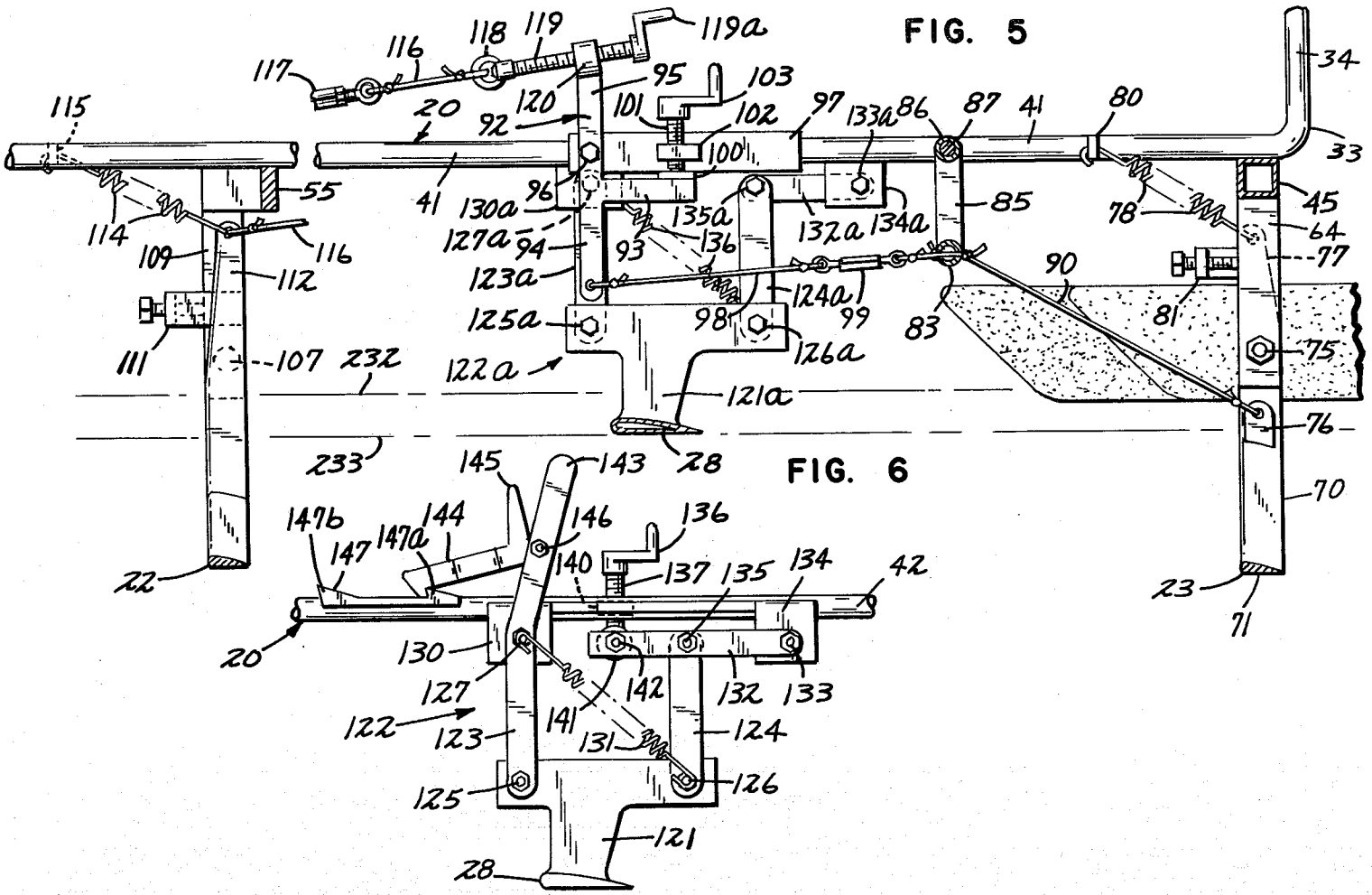
FIGS. 5 is an enlarged fragmentary sectional view taken along the line 5—5 of FIG. 1.
FIG. 6 is an enlarged fragmentary side view of a portion of the invention.

A plurality of support struts 63, 64, 65 and 66 extend downward from support member 45. As shown in FIG. 3, hydrofoil 23 is not straight, but is of angular configuration, being formed of two portions 69 and 70, of N.A.C.A. 4420 configuration, sloping downward to intersect at an apex 71 and provided with upward end tabs 72, 73 for pivotal connection to struts 63 and 64 by suitable fasteners 74 and 75 which are coaxial. A control tab 76 is secured to portion 70. End tab 73 is extended upwardly beyond fastener 75 to form a lever 77 which is connected by a biasing tension spring 78 to a bracket 80 on frame 20, to resiliently pivot the hydrofoil in a counterclockwise direction, as seen in FIGS. 2 and 5, about fasteners 74, 75 until lever 77 engages an adjustable stop 81 carried by strut 64. It will be apparent that the angle of attack of hydrofoil 23 with respect to the water can be varied by pivoting the hydrofoil on its fasteners 74, 75, stop 81 determining one end of the range of variation.

Hydrofoil 24 is similarly constructed and biased, being pivotally supported on struts 65 and 66 and having a control tab 82 and an end tab extended as a lever *77a*.

A cross member 83 has support brackets 84 and 85 depending from a tube 86 mounted on coaxial pivots 87 in frame 20, an is connected by cables 90 and 91 to hydrofoil control tabs 82 and 76. As shown in FIG. 5, a T-lever 92, having a cross arm 93 and aligned arms 94 and 95, is pivoted by a fastener 96 to a bracket 97 carried by side 41 of frame 20. Arm 94 is connected to cross member 83 by a cable 98 including a turnbuckle 99. Arm 93 carries a pad 100 which is engaged by the end of an adjusting rod 101 threadedly received in a boss 102 of bracket 97, and rotatable by a hand crank 103. Engagement of pad 100 with rod 101 is maintained by springs 78 acting through levers 77, *77a*, hydrofoils 23, 24, control tabs 76, 82, cables 91, 90, cross member 83, turnbuckle 99, and cable 98.

Hydrofoil 22 is constructed like hydrofoils 23 and 24: as shown in FIGS. 4 and 5, it has mounting tabs 104 and 105 pivotally secured by coaxial fasteners 106 and 107 in a pair of struts 108 and 109 depending from support member 55. Mounting tab 107 is extended upwardly as a lever 110 to cooperate with an adjustable stop 111 on strut 109, and a control tab 112 extends from hydrofoil 22 to cooperate with a biasing tension spring 114 acting against a bracket 115, as generally described above, to enable variation of the angle of attack of hydrofoil 22 through a range determined at one end by stop 111. A cable 116 including a turnbuckle 117 is connected from tab 112 to a swivel 118, see FIG. 5, carried on one end of a threaded rod 119 having a crank handle 119*a* fixed at its other end, and threadedly engaging a boss 120 on arm 95 of T-lever 92. By this arrangement, crank 103 is enabled to pivot hydrofoil 22 about fasteners 106, 107, spring 114 assisting in maintaining pad 100 in contact with shaft 101, and crank 119*a* provides for adjustment of the attack angle of hydrofoil 22 independent from hydrofoils 23 and 24.

Hydrofoils 22, 23 and 24 and their mounting struts 63, 64, 65, 66, 110 and 111 are so chosen that the upper ends of the hydrofoils project above the surface of the water when the vehicle is in motion.

Hydrofoil 28 is linear, transversely of the vehicle, is preferably hollow, and has a N.A.C.A. 5420 configuration. It is mounted on a pair of struts 121, 121*a* connected to the sides of frame 20 by a pair of parallel linkages 122 and 112*a*. Linkage 122 is best shown in FIG. 6. A pair of links 123 and 124 are pivoted to strut 121 by fasteners 125 and 126, at points spaced along the strut. Link 123 is pivoted at a fastener 127 to a bracket 130 carried by side 42 of frame 20, and a biasing tension spring 131 acts between fasteners 126 and 127. A lever 132 is pivoted at a fastener 133 to a bracket 134 carried by side 42 of frame 20, and link 124 is pivotally connected to lever 132 at a fastener 135. A hand crank 136 is fixed on an adjusting rod 137 threaded in a boss 140 carried by frame 20 and engages a swivel 141 pivoted to lever 132 at a fastener 142 beyond fastener 135 from fastener 133. Link 123 is extended upwardly as a handle 143, to which a pawl 144 having a handle 145 is pivoted at a fastener 146 so as to engage the teeth of a detent rack 147 carried by frame 20. Linkage 122*a* is like linkage 122, except that elements 136–147 are not necessary, and are eliminated. Springs 131 act across the diagonal of the parallelograms defined by fasteners 125, 126, 135 and 127 to cause links 123 and 124 to pivot clockwise about fasteners 127, 135 so that handle 143 draws pawl 144 to the right into engagement with rack 147.

Steering apparatus 21 includes a rudder 150 carried by a shaft 151, pivotable about a generally vertical axis in a mounting 152 and carrying at its upper end a cross bar 153 from which a pair of cables 154 and 155 extend rearwardly to a steering bar 156 to be held by the operator of the vehicle. Mounting 152 is arranged for pivoting about a transverse shaft 157 carried by frame 20, and a tension spring 160 acts between the center of frame 20 in front and a short arm 161 projecting forward from shaft 151, to give resilient centering of the rudder. A cable 162 is secured at one end to shaft 151 and at the other end to bracket 53 within reach of the vehicle's occupant: this cable has the dual function of normally restraining the rudder against tipping too far forward under the influence of spring 160, and of enabling the occupant to pivot the rudder backward to be lifted partially or entirely out of the water.

The rearward end of central reinforcing member 54 is configured as a bearing 163 for the crank shaft 164 of a pair of pedals 165 and 166. The crank shaft extends transversely of the vehicle, and carries a chain pinion 167. The forward end of shaft 36 also carries a chain pinion, 170, and the pinions are interconnected by a chain 171 having a 90° twist.

Figure 7:
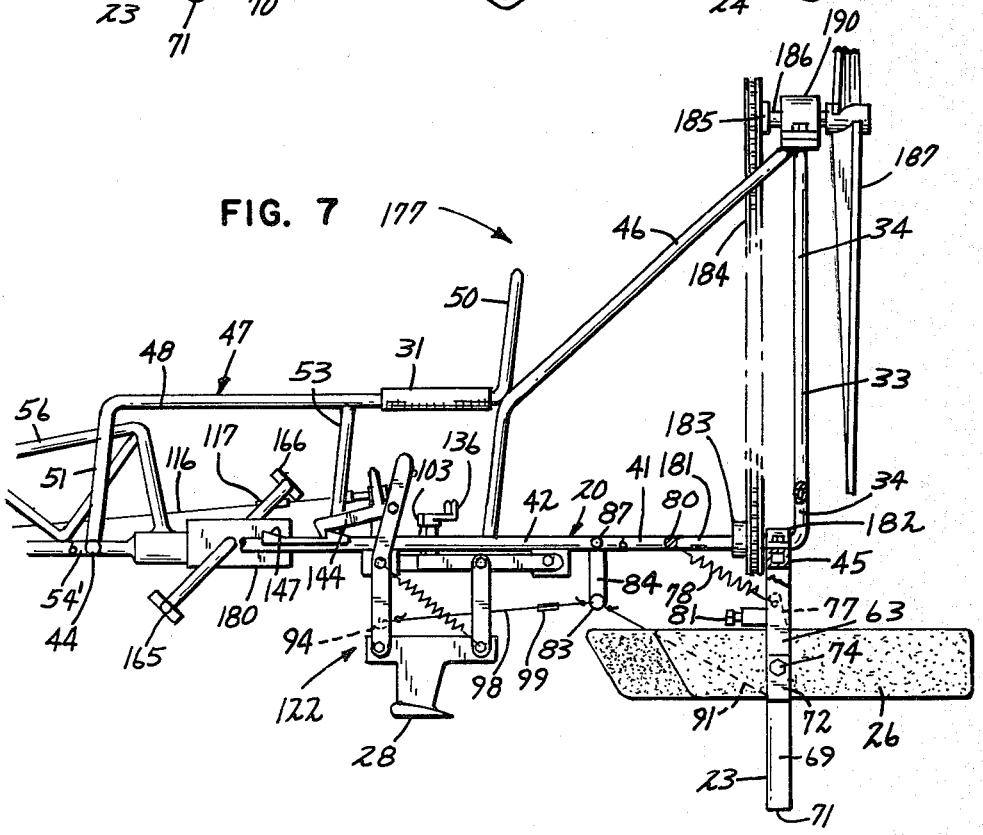
FIG. 7 is a fragmentary view like FIG. 2 but showing a modification of the air screw drive.

FIG. 7 shows a second vehicle 177 embodying the invention, in which the frame, steering apparatus, hydrofoils, and air screw are as in FIGS. 1–6. The rearward end of member 54' in this vehicle includes a gear box 180 by which the rotation of pedals 165 and 166 is converted to rotation of a drive shaft 181 extending rearwardly under seat 31 to a rear bearing 182 carried by member 45. Tube 86 is arched to clear shaft 181. Shaft 181 carries a chain pinion 183 which is connected by a chain 184 with a chain pinion 185 on the shaft 186 of air screw 187. Shaft 136 is carried in a suitable bearing 190: it is much shorter than shaft 36 of FIGS. 1–3, and this structure obviates the need for bracket 40.

Attention is now directed to FIGS. 8–10, which show a vehicle 200 embodying the invention and using a water screw rather than an air screw for propulsion. Here there is no need for brackets 34 and 40, otherwise the frame, steering apparatus, low speed hydrofoil, and front high speed hydrofoil are unchanged. The rear high-speed hydrofoil 201 is single rather than dual, although still V-shaped: it comprises two portions 202 and 203 of suitable streamline configuration sloping downward to intersect at a cylindrical housing 204. Members 202 and 203 and housing 204 are all hollow, and the housing acts as a bearing for a shaft 205 extending rearwardly through the housing and mounting a water screw 206. Hydrofoil 201 includes a pair of mounting tabs 207 and 210 pivotably mounted at coaxial fasteners 211 and 212 on struts 213 and 214 depending from support member 45. The ends of hydrofoil 201 always extend above the surface of the water.

An inverted U-shaped control member 215 is secured to hydrofoil 201, and is connected by tension springs 216 and 217 to a rear bracket 220 for seat frame 47, a bracket of the size of bracket 46 being no longer needed. A stop 221, which may be adjustable if desired, is carried by support member 45 for cooperation with control member 215. In this embodiment of the invention members 83–91 are not used: a cable 222 including a turnbuckle 223 is connected from lever arm 94 to member 215 near its point of connection to hydrofoil 201.

Drive shaft 181 carries a chain pinion 183 as before, but the drive chain 224 passes under pinion 183, over a pair of further pinions 225 and 226 rotatably mounted on member 45 at fasteners 227 and 230, and then through the hollow hydrofoil portions 202 and 203, passing under a further chain pinion 231 on shaft 205 within housing 204.

Operation

Consider first the vehicle 17 of FIGS. 1–6. In the stationary state the only lift action is the buoyant lift of hulls 25, 26, and 27, the lift of hollow hydrofoil 28 being negligible. No effort of the occupant is required to maintain this buoyant lift. The water line is indicated at 232. The stops 81 and 111 and turnbuckles 99 and 117 have been initially set, with cranks 103 and 119*a* in mid-positions, so that high speed hydrofoils 22, 23 and 24 are at angles of attack, for horizontal relative movement with respect to the water, which are those of maximum power efficiency (that is, maximum lift-to-drag ratio L/D) at a selected speed of fifteen miles per hour. The actual lift and drag forces which result are determined instantaneously by the actual speed of the vehicle and the extent of submergence of the hydrofoils below the surface.

Similarly, springs 131 initially hold linkages 122 and 122*a* in positions in which pawl 144 engages the right-hand tooth 147*a* of rack 147, so that the angle of attack of hydrofoil 28 is that of maximum lift-to-drag ratio L/D for horizontal relative movement with respect to the water at a selected speed of nine miles per hour.

The occupant now begins to operate pedals 165 and 166, actuating air screw 29 to cause forward movement of the vehicle. His energy is initially expended in overcoming the drag of the hulls and the lesser drag of the hydrofoils. As long as the hulls engage the water their drag is so large that it sets a very low upper limit on the speed obtainable, so it is desirable that they be lifted from the water as soon as possible. In the initial positions defined above, the hydrofoils might never produce enough lift at starting speeds to raise the vehicle by the necessary distance. Accordingly, the occupant turns cranks 103 and 136 to set the hydrofoils away from their initial positions into positions to give maximum lift forces at low speeds. Although the drag forces of the hydrofoils are not minimum here, they are still small compared with the drag of the hulls, and the new settings are such as to result in the rise of the vehicle as rapidly as possible.

By the time the vehicle has reached a speed of three miles per hour the hulls leave the water and the vehicle is supported only on the hydrofoils: the loss of buoyant lift as the hulls leave the water is compensated for by hydrodynamic lift from the increased speed. At this time high speed hydrofoils 22, 23 and 24 do not contribute much in the way of drag. The hydrofoils are designed so that at a vehicle speed of three miles per hour hydrofoil 28 supports 90% of the vehicle weight and hydrofoils 22, 23 and 24 support 10%.

With the drag of the hulls removed, the vehicle can be propelled at a much higher speed. It is now possible also for the occupant to reset the hydrofoils by cranks 103 and 136 toward positions of greater power efficiency, the increased speed maintaining sufficient lift to support the vehicle.

The horizontal component of the driving force of the air screw lies in a plane passing through the center of gravity of the vehicle, and is directed forwardly, and if the vehicle is being operated in a condition of no wind, the vehicle moves straight ahead: no steering is required, and rudder 150 may be removed from the water by use of cable 162. If cross wind is present, rudder operation may be necessary, the occupant operating steering bar 156 to cause vehicle movement in a desired direction in azimuth as long as may be necessary.

As power applied to the air screw changes, the moment of the driving force in the vertical plane passing through the center of gravity of the vehicle may change, so that a tendency of the vehicle to nose down or up may occur. To correct this, at any speed, the occupant operates crank 119*a*, to vary the relative angles of attack of the forward and rear hydrofoils, and hence their relative lift forces, so that the balance of the vehicle is maintained.

As the speed increases, the vehicle rises, and hydrofoil 28 is brought nearer and nearer to the surface of the water, where its efficiency becomes considerably less. The high speed hydrofoils also become less submerged, slightly decreasing their lift, but that decrease is more than overcome by the increase due to increased vehicle speed, so that at nine miles per hour the high speed hydrofoil supports most of the weight of the vehicle. The drag force of hydrofoil 28 also becomes significantly larger at higher speeds. Accordingly, the occupant now pushes lever 143 forward so that pawl 144 engages rack tooth 147*b*, thus raising hydrofoil 28 entirely out of the water. This results in some loss of total lift, but as the vehicle begins to sink down the water engages larger portions of the high-speed hydrofoil surfaces, and only a minor change in vehicle height results. The vehicle is now moving on hydrofoils 22, 23 and 24 only, and crank 143 can be adjusted to maintain the angles of attack of these hydrofoils at those of maximum power efficiency for each increment of speed increase, to result in minimum power demand on the occupant.

As the maximum rated speed of the vehicle is approached, the operator may actuate cable 162 to raise rudder 150 out of engagement with the water, thus still further reducing the drag of the vehicle. The rudder can still be restored to its operative position, by spring 160, if need for a change in heading of the vehicle should arise. The water level is indicated at 233.

A principle to be borne in mind in operating the various controls of the vehicle is to always cause the most efficient lifting component to produce the greatest part of the total lift, even though that component might have to operate at less than its greatest individual power efficiency.

The operation described above is the same for vehicles 177 and 200. Hydrofoil 201, like hydrofoils 23 and 24 in FIG. 3, extends above the water surface to give slightly varying lift at different degrees of submergence, for different vehicle speed.

From the foregoing it will be evident that I have invented vehicles designed for operation in water by the power of a single human occupant. Each vehicle includes a frame, floats or hulls, low and high speed hydrofoils, an air screw or a water screw driven by pedals actuated by the human occupant, and means for varying the angles of attack of the hydrofoils and for retracting the low speed hydrofoil, and the rudder of a steering mechanism, out of engagement with the water when this is advantageous.

Although the several embodiments of my invention show numerous refinements, it will be apparent that several simplifications are also possible, especially if less demands are made upon the vehicle. Under appropriate conditions it may be possible to dispense with the adjustment of relative angles of attack between the forward and rearward hydrofoils, or with one or more of the means for varying the angles of attack of the hydrofoils. It may also be desirable to design a vehicle which uses only one hydrofoil means instead of two, or which does not require the raising of a low-speed hydrofoil: on the other hand, it may prove desirable under some circumstances to use more than two hydrofoil means, suitably designed and adjusted.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. An occupant powered hydrofoil vehicle comprising, in combination:

a lightweight frame constructed from a plurality of interconnected tubular members, said frame including a forward end, a rearward end, and a seat disposed between the ends for supporting an occupant in a generally sitting position immediately above the surface of a body of water;

hydrofoil means depending from said frame for generating lift during vehicle movement, said hydrofoil means including a low-speed hydrofoil extending transversely generally beneath the seat on said frame, and constructed and arranged for primary use at low rates of vehicle movement, a first high-speed hydrofoil of generally V-shape configuration positioned at the forward end of said frame, and second and third high-speed hydrofoils positioned in laterally spaced apart relationship at the rearward end of said frame, said high speed hydrofoils being constructed and arranged for primary use at relatively higher rates of vehicle movement;

steering means including a rudder mounted on said frame for controlling directional movement of the vehicle, said steering means being adapted for manual actuation by the occupant;

means including a plurality of spaced apart hulls for supporting said frame at the surface of the body of water when said vehicle is stationary, said hydrofoil means being at least partially submerged in the body of water when said vehicle is stationary; and drive means powered by the occupant for propelling said frame forward with respect to the body of water, said drive means including an air screw mounted behind the seat on the rearward end of said frame, and a transmission adapted for manual operation by the seated occupant for effecting rotation of said air screw, so that said frame and said hull means are lifted above the surface of the body of water by said hydrofoil means as the rate of vehicle movement increases.

2. A vehicle according to claim 1 including means for varying the angle of attack of each of said high-speed hydrofoils for achieving maximum power efficiency as defined by a ratio of lift-to-drag at any given rate of vehicle movement, said means for each hydrofoil including an occupant controlled lever, an adjustable stop secured to a portion of said hydrofoil and a biasing spring connecting said lever to said stop.

3. A vehicle according to claim 1 wherein said steering means includes a steering bar connected to the rudder, spring means for normally biasing the rudder to a centered position, and means for supporting the rudder on said frame for selective movement of the rudder into and out of the water by the occupant.

4. An occupant powered hydrofoil vehicle comprising, in combination:

a lightweight frame constructed from a plurality of interconnected tubular members, said frame having a forward end, a rearward end and a seat disposed between the ends for supporting an occupant in a substantially sitting position immediately above the surface of a body of water;

high-speed hydrofoil means depending from said frame, said means including a first high-speed hydrofoil of generally V-shape configuration positioned at said forward end of said frame and a second high-speed hydrofoil of generally V-shape configuration substantially larger than said first high-speed hydrofoil, positioned at said rearward end of said frame, said high-speed hydrofoils adapted for primary use at high rates of vehicle movement;

low-speed hydrofoil means depending from said frame intermediate said first and second high-speed hydrofoils, said means including a substantially linear hydrofoil extending transversely generally beneath the seat on said frame;

means for varying the angle of attack of each of said high speed hydrofoils, each of said varying means including an occupant controlled lever and means connected to said lever for enabling differential variation in the angles of attack to achieve maximum power efficiency as defined by a ratio of lift-to-drag at any given vehicle speed including an adjustable stop and a biasing spring;

means including a plurality of spaced apart hulls for supporting said frame at the surface of the body of water when said vehicle is stationary with each of said hydrofoil means being at least partially submerged in the body of water;

drive means powered by the occupant for propelling said frame forward with respect to the body of water, said means including a water screw proximate said second high-speed hydrofoil at said rearward end of said frame and a transmission manually actuable by the seated occupant for effecting rotation of said water screw, so that as the rate of vehicle movement increases said hydrofoil means elevates said frame and said hull means above the water surface; and steering means for controlling the directional movement of the vehicle, said means including a rudder, a steering bar connected to said rudder and spring means for normally biasing said rudder to a centered position, said rudder being connected to said steering bar in a manner allowing the occupant to manually control the engagement of said rudder with the body of water.

5. A vehicle according to claim 1 or 4 including means actuable by the occupant for raising said low speed hydrofoil means above said hull means as said vehicle reaches high rates of movement with said frame substantially supported above said water surface by said high speed hydrofoil means said raising means including a spring-biased, parallel linkage connecting said low speed hydrofoil means to said frame and means for securing the hydrofoil means in a raised position.

* * * * *